US007159585B2

(12) United States Patent
Quinn et al.

(10) Patent No.: US 7,159,585 B2
(45) Date of Patent: Jan. 9, 2007

(54) FIRING ASSEMBLY FOR COMPRESSED GAS OPERATED LAUNCHING DEVICE

(75) Inventors: Michael Quinn, East Hanover, NJ (US); Mel Maravilla, Jersey City, NJ (US); Kerry Johnson, Madison, NJ (US)

(73) Assignee: National Paintball Supply, Inc., Sewell, NJ (US)

( * ) Notice: Subject to any disclaimer, the term of this patent is extended or adjusted under 35 U.S.C. 154(b) by 0 days.

(21) Appl. No.: 11/064,693

(22) Filed: Feb. 23, 2005

(65) Prior Publication Data

US 2006/0005822 A1 Jan. 12, 2006

Related U.S. Application Data

(60) Provisional application No. 60/546,219, filed on Feb. 23, 2004.

(51) Int. Cl.
*F41B 11/00* (2006.01)

(52) U.S. Cl. ..... 124/73; 124/75

(58) Field of Classification Search ..... 124/73–77
See application file for complete search history.

(56) References Cited

U.S. PATENT DOCUMENTS

| | | | |
|---|---|---|---|
| 2,357,951 | A | 9/1944 | Hale |
| 3,463,136 | A | 8/1969 | Vadas et al. |
| 4,770,153 | A | 9/1988 | Edelman |
| 4,819,609 | A | 4/1989 | Tippmann |
| 4,865,009 | A | 9/1989 | Ford et al. |
| 5,063,905 | A | 11/1991 | Farrell |
| 5,333,594 | A | 8/1994 | Robinson |
| 5,377,655 | A | 1/1995 | Arad |
| 5,462,042 | A | 10/1995 | Greenwell |
| 5,515,838 | A | 5/1996 | Anderson |
| 5,613,483 | A | 3/1997 | Lukas et al. |
| 5,890,479 | A | 4/1999 | Morin |
| 6,003,504 | A | 12/1999 | Rice et al. |
| 6,065,460 | A | 5/2000 | Lotuaco, III |
| 6,138,656 | A | 10/2000 | Rice et al. |
| 6,302,092 | B1 | 10/2001 | Juan |
| 6,343,599 | B1 | 2/2002 | Perrone |
| 6,360,736 | B1 | 3/2002 | Juan |
| 6,439,217 | B1 | 8/2002 | Shih |
| 6,474,326 | B1 | 11/2002 | Smith et al. |
| 6,553,983 | B1 | 4/2003 | Li |

(Continued)

FOREIGN PATENT DOCUMENTS

| | | |
|---|---|---|
| EP | 0 467 089 B1 | 10/1995 |

(Continued)

OTHER PUBLICATIONS

Tippman Pneumatics Inc., Owner's Manual: "98 Custom", pp. 1-18.

*Primary Examiner*—Stephen M. Johnson
*Assistant Examiner*—Gabriel J. Klein
(74) *Attorney, Agent, or Firm*—Volpe and Koenig, P.C.

(57) ABSTRACT

A pneumatic assembly for a compressed gas gun having a hammer chamber including a hammer conduit, and a hammer with an aperture surrounding at least a portion of the hammer conduit. A compressed gas gun has a breech, a bolt moveable within the breech from a loading position to a firing position, a pneumatic assembly in communication with the breech, the pneumatic assembly comprising a high pressure chamber, and a hammer chamber. A discharge valve is disposed in the pneumatic assembly between the high pressure chamber and hammer chamber. A solenoid valve is provided for selectively supplying compressed gas to the hammer conduit.

19 Claims, 10 Drawing Sheets

U.S. PATENT DOCUMENTS

| | | | |
|---|---|---|---|
| 6,557,542 | B1 | 5/2003 | Orr |
| 6,561,176 | B1 | 5/2003 | Fujimoto et al. |
| 6,618,975 | B1 | 9/2003 | Shih |
| 6,637,420 | B1 | 10/2003 | Moritz |
| 6,637,421 | B1 | 10/2003 | Smith et al. |
| 6,658,982 | B1 | 12/2003 | Cherry |
| 6,763,822 | B1 | 7/2004 | Styles |
| 6,832,605 | B1 | 12/2004 | Farrell |
| 6,857,423 | B1 | 2/2005 | Jong |
| 6,889,681 | B1 | 5/2005 | Alexander et al. |
| 2001/0042543 | A1 | 11/2001 | Perrone |
| 2003/0024520 | A1 | 2/2003 | Dobbins |
| 2003/0079731 | A1 | 5/2003 | Dobbins |
| 2003/0178018 | A1 | 9/2003 | Cherry |
| 2004/0216728 | A1 | 11/2004 | Jong |
| 2005/0109329 | A1 | 5/2005 | Janavicius |
| 2005/0166747 | A1 | 8/2005 | Chenery et al. |

FOREIGN PATENT DOCUMENTS

| | | | |
|---|---|---|---|
| EP | 1 197 723 | A2 | 4/2002 |
| EP | 1 209 435 | A2 | 5/2002 |
| EP | 1 209 435 | A3 | 11/2002 |
| EP | 1 197 723 | A3 | 3/2003 |
| GB | 2 258 913 | A | 2/1993 |

FIRING ASSEMBLY FOR COMPRESSED GAS OPERATED LAUNCHING DEVICE

CROSS REFERENCE TO RELATED APPLICATION(S)

This application claims the benefit of U.S. Provisional application No. 60/546,219, filed Feb. 23, 2004, which is incorporated by reference as if fully set forth.

FIELD OF INVENTION

This invention relates to an assembly for a compressed gas gun, and more particularly, to a novel pneumatic assembly including a novel hammer and valve arrangement for a compressed gas gun.

BACKGROUND

Paintball is a sporting game having two teams of players usually trying to capture one another's flag. The sport is played on a large field with opposing home bases at each end. Each team's flag is located at the player's home base. In addition, all of the players have compressed gas guns, referred to herein as either "compressed gas guns" or "paintball markers", that shoot projectiles commonly referred to as paintballs. These paintballs are generally spherical gelatin capsules filled with paint. During play of the sport, the players on each team advance towards the opposing team's base in hopes of stealing the opposing team's flag, without being eliminated from the war game. A player is eliminated from the game when the player is hit by a paintball fired from an opposing player's marker. When the paintball hits a player, a "splat" of paint is left on the player.

Compressed gas guns using compressed gas or air for firing projectiles are well known. As used herein, compressed gas gun refers to any gun wherein a projectile is fired via the force of compressed gas, and includes paintball markers. As used herein, projectiles refers to both paintballs, and other projectiles used in sport and game play.

Paintball markers have two basic mechanisms that operate for firing a paintball from the marker during a firing operation. One of these mechanisms is for chambering a paintball in the breech of a paintball marker. This mechanism usually involves the use of a bolt that reciprocates from a loading position to a firing position in the chamber of the marker. The other mechanism operates to release a burst of compressed gas to propel the paintball from the breech and out the barrel of the marker. This mechanism usually involves either a mechanically controlled or electronically controlled valving system.

A variety of different types of paintball markers exist in the field, using a variety of mechanisms for accomplishing their purpose of projecting paintballs. Two of the types of "actions" are the open bolt action and the closed bolt action.

In the open bolt action, the gun body comprises two parallel tubular chambers or bores. The upper chamber contains the bolt, while the lower chamber includes a hammer and at least one discharge or pin-type valve, also referred to as an exhaust or firing valve. The lower chamber also houses a pin valve that opens and closes a flow passage between a high pressure chamber, and the upper chamber. The bolt and hammer components are linked together, usually via a mechanical linkage, allowing them to move in concert. The bolt and hammer assembly is held in the cocked position via a trigger sear, which catches the hammer portion of the assembly. In this position, the breech is open and a paintball is able to drop via an infeed tube into position in front of the bolt. When the trigger is pulled, the sear releases the hammer and a spring drives the hammer and bolt forward. As the bolt moves forward, it chambers a paintball into the barrel of the marker gun. In the lower chamber, the hammer moves forward to strike the pin valve and open the flow passage. The pin valve releases a burst of high pressure gas into and through the bolt, expelling the paintball from the barrel.

The closed bolt action differs from the open bolt action in that in the closed bolt action, when the marker gun is in the cocked configuration the bolt is in the closed position, and a paintball is already chambered in the barrel. Also, in a closed bolt action, the hammer and bolt move independently. Since a ball is chambered with the bolt stationary while the hammer moves, there is less "bounce" or "kick" during firing of the marker. Additionally, the paintball is not impacted by the bolt immediately before it is discharged from the marker gun, and therefore, the paintball should experience less surface distortion. This combination of fewer inertial forces and reduced distortion of the surface of the projectile may improve precision and accuracy of a closed bolt marker over the same marker using an open bolt action.

In the "autococking" action paintball marker, when the trigger is pulled, the hammer is released, striking the valve and sending gas through the bolt and down the barrel, thus firing a paintball. Gas is also vented to a low pressure regulator, which in turn supplies a three-way valve. The three-way valve is connected to a pneumatic ram, which in turn is mechanically linked to a back block cocking mechanism and to the bolt.

The consistency with which paintballs are chambered and with which compressed gas is released greatly impacts the accuracy of a paintball marker. It would be advantageous to have a compressed gas gun where the chambering and valving mechanisms are completely independent. In addition, it would be advantageous to have a compressed gas gun with a pneumatic assembly where the hammer was operated by compressed gas directly supplied by a solenoid valve, and where the pneumatic assembly includes a way to channel compressed gas directly to the hammer while avoiding loss of compressed gas, to increase the efficiency of the compressed gas gun. In addition, it would be advantageous to have a pneumatic assembly for firing a compressed gas gun where there are few moving parts.

There is, accordingly, the need for a pneumatic assembly for a compressed gas gun, comprising a hammer and valving arrangement that is simple in construction, has few moving parts, is completely independent of the bolt system, and is easily adjustable.

SUMMARY

Briefly stated, the present invention is directed to a novel pneumatic assembly for a compressed gas gun. The novel pneumatic assembly can be utilized in either a closed bolt or an open bolt action compressed gas gun, although it is preferred that the novel pneumatic assembly be incorporated into a closed bolt action compressed gas gun.

A compressed gas gun comprising the pneumatic assembly of the present invention comprises a compressed gas gun body having a breech, a bolt moveable within the breech from a loading position to a firing position, and a pneumatic assembly in communication with breech. A hammer conduit is provided within a hammer chamber at the rearward portion of a pneumatic assembly. A hammer for impacting a discharge valve is provided within the hammer chamber, the hammer being moveable from a ready-to-fire position to a firing position. At least a portion of the hammer receives at least a portion of the hammer conduit. When the trigger of the compressed gas gun is actuated (pulled) to initiate a firing operation, compressed gas flows through the hammer conduit, forcing the hammer forward in the hammer chamber. The hammer impacts a discharge valve, opening a flow passage between a high pressure chamber and the bolt.

The present invention also relates to a pneumatic assembly comprising a high pressure chamber, a hammer chamber, and a discharge valve between the high pressure chamber and hammer chamber. The hammer is biased to a ready-to-fire or first position by a hammer return spring. Compressed gas from a compressed gas source is routed to the rear of the hammer through a hammer conduit, propelling the hammer forward toward the discharge valve. A hammer return spring is positioned forward of the hammer, biasing the hammer toward the ready-to-fire position. As the hammer moves forward, the hammer return spring is compressed. The hammer contacts the stem of the discharge valve, opening a flow passage releasing compressed gas to fire the paintball from the compressed gas gun. The compressed gas behind the hammer is vented, allowing the hammer return spring to return the hammer to the ready-to-fire position.

The present invention is also directed to a conversion kit for modifying a compressed gas gun to include a pneumatic assembly of the present invention.

BRIEF DESCRIPTION OF THE DRAWING(S)

Additional objects and advantages of the present invention will become apparent to those ordinarily skilled in the pertinent arts upon reading the following detailed description of a particularly preferred embodiment of the invention, which illustrates the best mode contemplated for practicing the invention, taken in conjunction with the accompanying drawings.

DETAILED DESCRIPTION OF THE PREFERRED EMBODIMENT(S)

Figure 1:
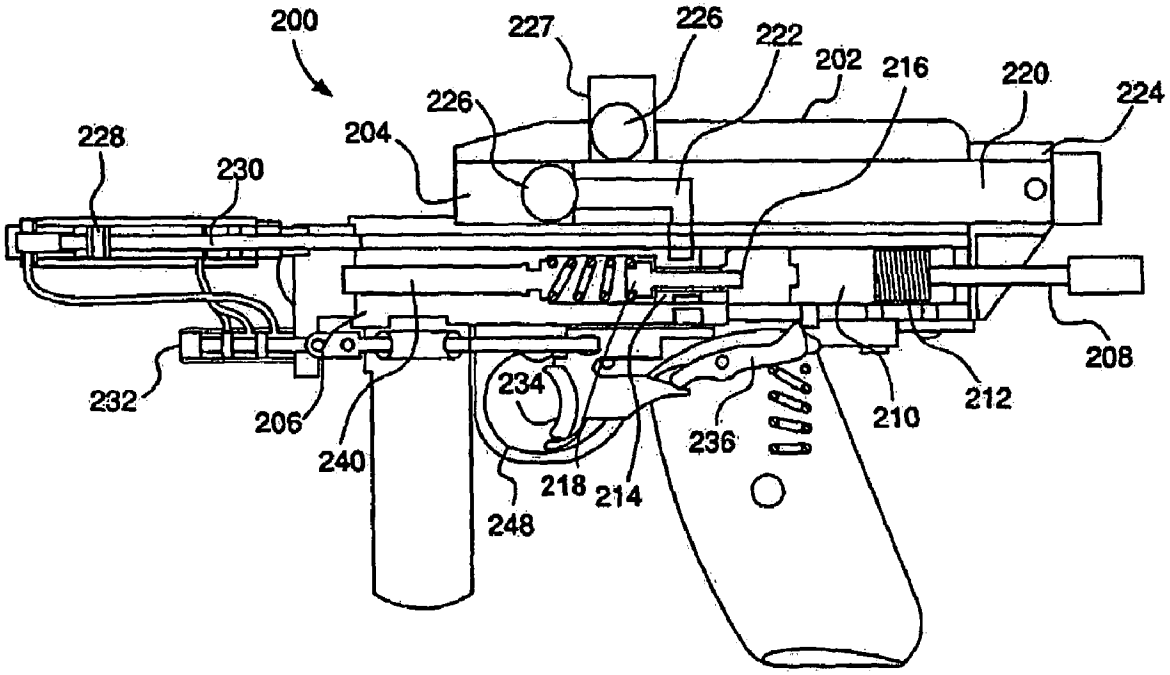
FIG. 1 (PRIOR ART)
FIG. 1 is a side cross-sectional side view of a compressed gas gun of the closed bolt "autococking" variety as is known in the art.

Certain terminology is used in the following detailed description for convenience only and is not considered limiting. A preferred embodiment of a compressed gas gun and pneumatic assembly of the present invention is disclosed here and in the Figures. For clarity, within this document all reference to the top and bottom of the compressed gas gun and pneumatic assembly will correspond to the compressed gas gun as oriented in FIG. 1. Likewise, all reference to the front or forward portion of said compressed gas gun and pneumatic assembly will correspond to the leftmost part of said gun as viewed in FIG. 1, and all reference to the rear portion of said compressed gas gun and pneumatic assembly will correspond to the rightmost part of said compressed gas gun and pneumatic assembly as viewed in FIG. 2. The words "upper" and "lower" designate directions in the drawings to which reference is made. The words "forward" and "rear" designate directions in the drawings to which reference is made. Additionally, the terms "a" and "one" are defined as including one or more of the referenced item unless specifically noted.

A cross sectional side view of an illustrative prior art closed bolt mechanically cocking, or "autococking," compressed gas gun is shown in FIG. 1. A close bolt compressed gas gun 200 of the "autococking" action has a gun body 202, having an upper chamber or breech 204, and a lower chamber 206. The lower chamber 206 houses a cocking rod 208 which projects out of the back of the gun body, and is connected to a hammer 210. The hammer 210 is biased forward by a spring 212. An exhaust valve 214 is provided in the lower chamber having a stem 216 on the side of the hammer 210, and a valve seat 218 on the opposite side of the exhaust valve 214. A high pressure chamber 240 receives compressed gas from a compressed gas source (not shown). Generally, the source of compressed gas is a compressed gas tank, as is well known in the art.

As shown in FIG. 1, the upper chamber 204 houses a bolt 220 having an aperture therethrough 222. The bolt 220 is attached to a back block 224. Paintballs 226 are received in the upper chamber 204 via an infeed opening 227.

A ram 228, which acts as a piston, is connected to a rod 230 that is attached to the back block 224. The ram 228 is controlled by a three-way valve 232 that is mechanically connected to a trigger 234 that is housed in a trigger frame 248. When the trigger 234 is actuated (pulled), the three-way valve 232 shunts compressed gas to the forward end of the ram 228 which in turn moves the ram and back block rearward, placing the bolt in a loading position. When this happens, the block pulls the bolt and cocking rod back as well. The bolt 220 is now in a loading position which allows a paintball to fall into the chamber. The cocking rod 208 is also moved rearward by the back block, so the hammer 210 is also pulled back until the sear 236 catches on the trigger. When the trigger is released, the three-way shunts compressed gas to the rearward portion of the ram, pulling the back block forward, thereby closing the bolt. The compressed gas gun is now prepared for firing. Actuating the trigger releases the sear, the spring biases the hammer forward to hit the seat, the exhaust valve opens to send compressed gas through the bolt, and the paintball is fired, automatically starting the process over again to load the next paintball. Several companies offer "autococking" compressed gas guns of the closed bolt design described herein, including, by way of example, SHOCKTECH, KAPP and DYE.

As can be discerned from the above description, the mechanical back block, cocking rod and sear arrangement is not efficient. The present invention eliminates the cocking rod and hammer arrangement of known "autococking" compressed gas guns, eliminates the sear, may eliminate the three-way valve, and provides a simple, efficient pneumatic firing system that may be electronically controlled.

Figure 2:
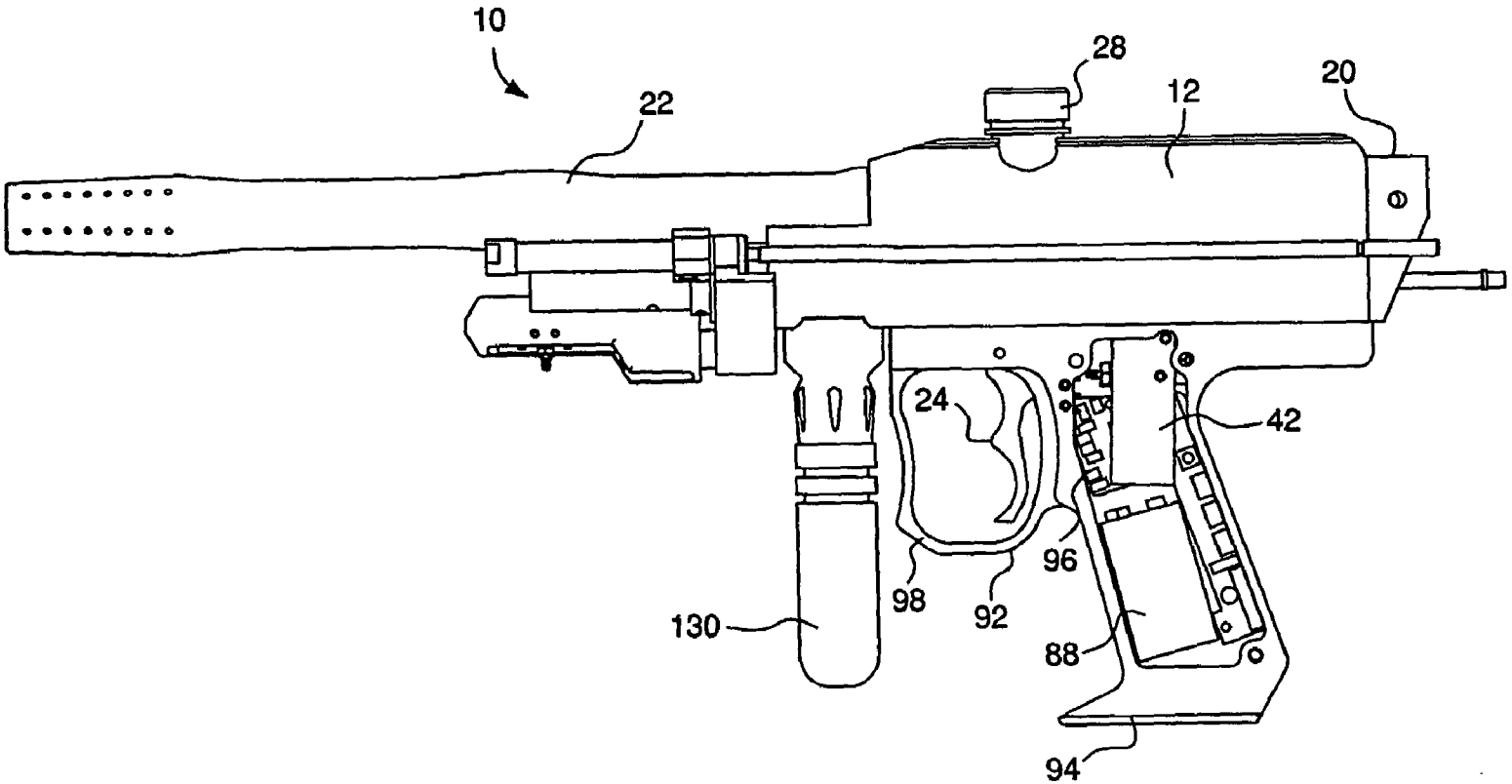
FIG. 2 is a side elevation view of a compressed gas gun according to the present invention.
Figure 3:
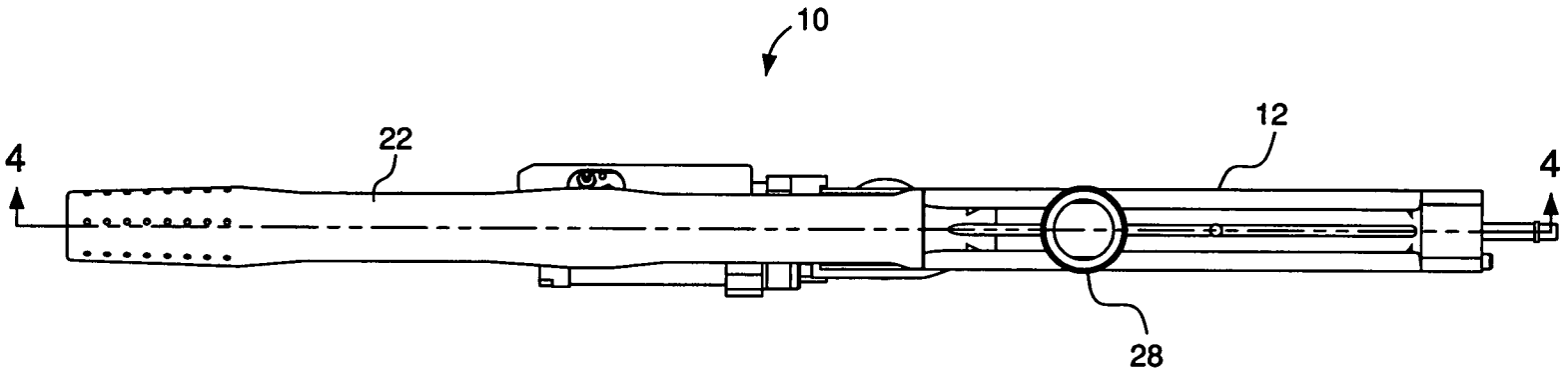
FIG. 3 is a top plan view of the compressed gas gun of FIG. 2.

Referring now to FIGS. 2–5, a first embodiment of a compressed gas gun 10 having a gun body 12 and the pneumatic assembly 32 of the present invention is shown. The compressed gas gun 10 shown in FIG. 2 is of the closed bolt action type, similar to the type described in detail in U.S. Pat. No. 6,763,822.

Figure 4:
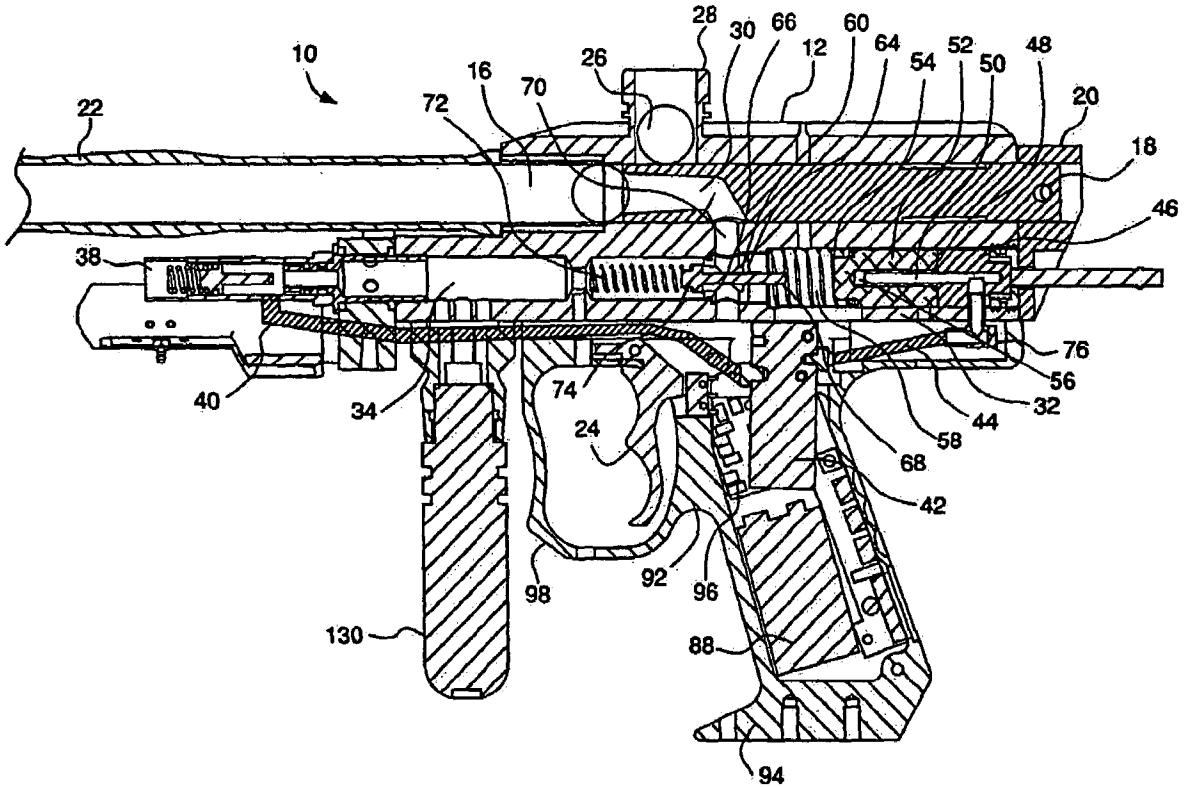
FIG. 4 is a cross-sectional side view of the compressed gas gun of FIG. 2, taken along line 4—4 of FIG. 3.
Figure 5:
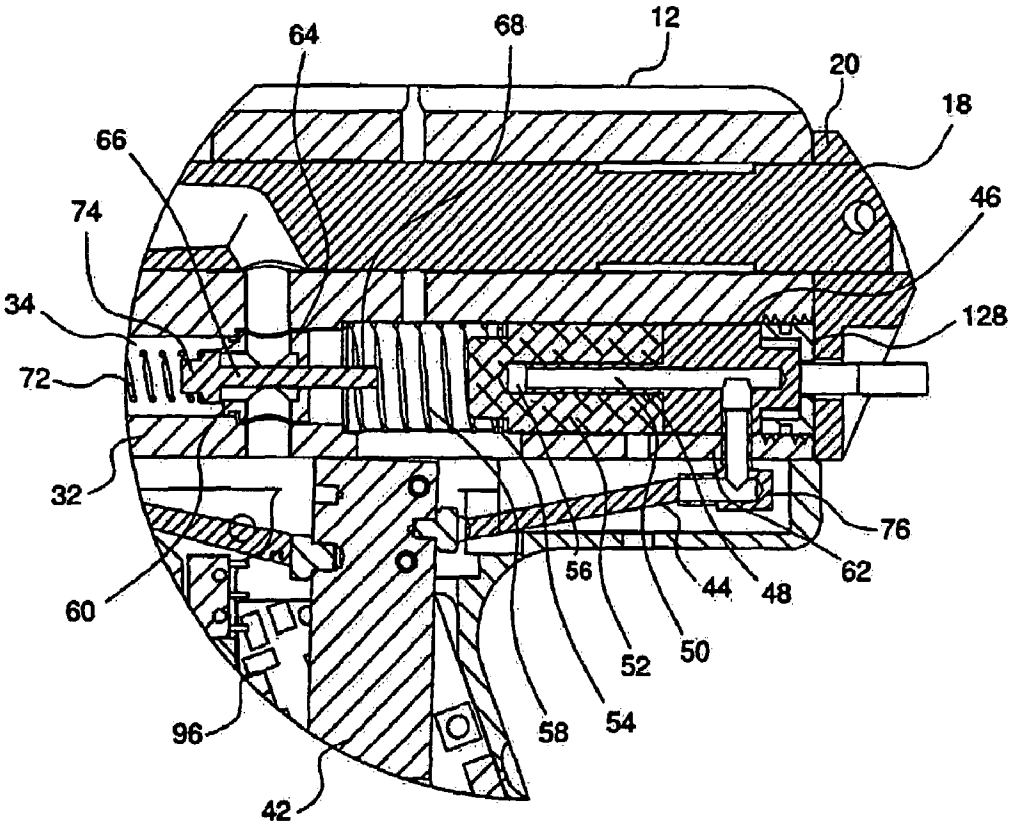
FIG. 5 is a close up detailed cross-sectional side view of a portion of a compressed gas gun having a pneumatic assembly according to the present invention.

The gun body 12, shown in detail in FIGS. 4 and 5, has a breech 16 which chambers paintballs for firing. A paintball infeed tube 28 is provided for receiving paintballs 26 into the breech 16. The infeed tube 28 may be attached to a paintball hopper or loader (not shown) mounted on top of the compressed gas gun 10. A barrel 22 may be permanently or removeably attached to the gun body 12, such as by threaded engagement. A trigger frame 92 having a grip portion 94 may also be attached to the gun body 12. The trigger frame 92 includes a trigger guard 98 that protects the trigger 24, and may also house assemblies and electronics for operation of the compressed gas gun, such as a solenoid valve 42, described in greater detail below.

During a firing operation, which is initiated by actuation of the trigger 24 (i.e., pulling the trigger 24), closed bolt compressed gas guns begin in the firing position, as shown in FIG. 2, with a paintball chambered in the breech 16, ready for firing out of the barrel 22 of the compressed gas gun 10. A bolt 18 is provided within the breech 16. The bolt 18 has a bolt aperture 30 therethrough, permitting the passage of compressed gas for firing a paintball. The bolt 18 is moveable from a rearward loading position to a forward firing position, with the firing position shown in FIG. 2. The bolt 18 may be attached to a pneumatically operable ram and rod as described above and shown in FIG. 1, that may be attached either directly to the bolt, or to a back block 20 shown in FIG. 2. However, it is contemplated that a compressed gas gun made according to the present invention may include a bolt that reciprocates by means other than a ram, rod and back block arrangement, such as by blow back gas, a spring arrangement, or by alternately directing compressed gas to the forward and rearward portions of the bolt 18. Any means for reciprocating the bolt may be used without departing from the present invention. In the closed bolt arrangement, the bolt movement should be independent from the movement of the pneumatic assembly, as discussed in greater detail below.

As shown in FIGS. 4 and 5, pneumatic assembly 32 is provided, which preferably extends along the lower portion of the gun body 12, and is in communication with the breech 16. The pneumatic assembly 32 has a forward portion and a rearward portion. The forward portion of the pneumatic assembly 32 comprises a high pressure chamber 34 which receives compressed gas from a source of compressed gas, such as a compressed gas tank (not shown). A low pressure regulator 38 may be provided at a forward portion of the pneumatic assembly 32, in communication with the high pressure chamber 34. The low pressure regulator 38 may be used for adjustment of the operation of the compressed gas gun, as is known in the art. Compressed gas is supplied to a conduit 40, which is in communication with a solenoid valve 42, which will be described in greater detail below. Compressed gas may also be supplied by the source of compressed gas (not shown) directly to the solenoid valve 42. It is appreciated that a compressed gas gun utilizing the pneumatic assembly of the present invention may not be equipped with a low pressure regulator without departing from the present invention. If a low pressure regulator is not employed, the conduit 40 may communicate directly with the high pressure chamber 34. In addition, an "in-line" regulator 130 may be used to adjust the compressed gas pressure from the compressed gas source.

The pneumatic assembly 32 further comprises a hammer chamber 62 which is preferably at the rearward portion of the pneumatic assembly 32. A hammer conduit 46 is provided in rear portion of the hammer chamber 62 in communication with the solenoid valve 42 via conduit 44. The hammer conduit 46 has at least a portion that comprises a tube wall, designated herein as a hammer conduit wall extension 48, having a diameter D1, and having an aperture 50 therethrough, as shown in detail in FIG. 5.

A hammer 52, moveable from a ready-to-fire or first or rear position, to a firing or second or forward position, is disposed within the hammer chamber 62. The hammer comprises a striking portion 54 at the forward end of the hammer 52. The hammer 52 includes an aperture 56 sized for receiving the hammer conduit wall extension 48. The aperture 56 of the hammer 52 has a diameter D2 that is greater than the diameter D1 of the hammer conduit wall extension 48. Thus, the aperture 56 coaxially surrounds the hammer conduit wall extension 48. A hammer return spring 58 is positioned forward of the hammer 52 in the hammer chamber 62, biasing the hammer 52 to a ready-to-fire, or rear, position. However, it is appreciated that the hammer return spring could be located in any suitable position, and can be a compression or tension spring, depending on the location.

A discharge valve 60 is provided between the high pressure chamber 34 and the hammer chamber 62. The discharge valve 60 may be any valving mechanism that can selectively supply compressed gas to the breech upon being struck by the hammer 52. In one embodiment of the present invention, the discharge valve 60 is a pin valve that includes a seat member 64 movably receiving a pin valve member 66. The pin valve member 66 includes an elongate stem portion 68 extending rearwardly through the seat member 64, and a sealing portion 74 forward of the seat member 64. A flow passage 70 (also referred to as a "flow path", both "flow passage" and "flow path" being used interchangeably herein) is provided through the seat member 64 and provides communication between the high pressure chamber 34 and the aperture 30 of the bolt 18 when the pin valve member 66 is unseated. A valve spring 72 is provided, biasing the pin valve member 66 rearward, and therefore, sealing the flow passage 70 until the stem portion 68 is struck by the hammer 52.

A plug 128 may be provided at the rear of the hammer chamber 62, threadably attached to the gun body 12. Removal of the plug 128 allows for easy access, adjustment, and replacement of the various components of the pneumatic assembly 32 of the present invention. The plug 128 may also be used to adjust the axial position of the hammer conduit, thereby controlling movement of the hammer 52 against the hammer return spring 58.

A compressed gas gun having the pneumatic assembly of the present invention operates as follows. In a closed bolt arrangement, the bolt 18 of the compressed gas gun 10 begins in the firing or forward position, as shown in FIG. 2. In this example, a paintball has already been chambered, and is in position for firing. The trigger 24 is pulled (actuated) by a user, opening a flow passage in the solenoid valve 42, and allowing compressed gas to travel through the hammer conduit 46. It is appreciated that the trigger 24 may actuate the solenoid valve through an electronic signal, or mechanically.

The compressed gas released by the solenoid valve flows through conduit 44, through the hammer conduit 46, and acts upon the hammer 52. The hammer is moved by the force of compressed gas channeled through the hammer conduit 46 toward the forward or firing position, against the bias of the hammer return spring 58. Thus, in order to fire the compressed gas gun, the force of the compressed gas flowing through the hammer conduit 46 must be able to overcome the bias of the hammer return spring 58.

The components of the gun body, or discrete components of the pneumatic assembly, may be offered as parts of a kit, with selective parts of the gun body or pneumatic assembly described herein included in the kit, so that a user may convert a compressed gas gun to operate according to the present invention.

So that the hammer 52 may be returned to a ready-to-fire position, compressed gas may be vented rearward of the hammer 52, such as through a vent hole formed at an appropriate position in the gun body 12. In another embodiment, a valve 76, such as an elbow valve or a quick exhaust valve (or QEV) as is known in the art may be used at the junction of the conduit 44, and the hammer conduit 46. It is appreciated that while use of the quick exhaust valve allows a faster return of the hammer, it is not required.

Figure 6:
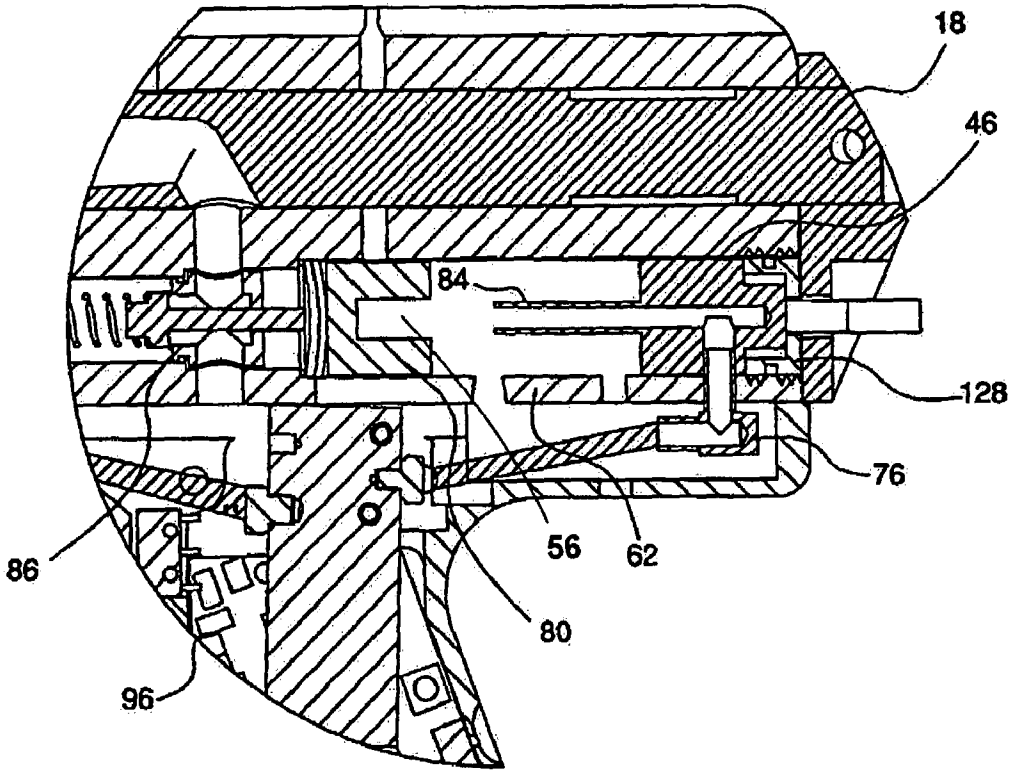
FIG. 6 is a close up detailed cross-sectional side view of a portion of an alternate embodiment of a compressed gas gun having a pneumatic assembly according to the present invention.

In another embodiment of the present invention, as shown in FIG. 6, the hammer 80 and hammer conduit wall extension 84 may be arranged within the hammer chamber so that in the forward or firing position, the hammer 80 moves off of and exposes the hammer conduit wall extension 84, leaving a gap between the hammer 80 and the hammer conduit wall extension 84 as the hammer 80 travels toward the discharge valve 86. Compressed gas traveling through the hammer conduit 82 will vent, and may be released either through a vent hole in the gun body, or through an exhaust valve as previously discussed.

As shown in the Figures, the illustrative embodiment of the present invention shows the trigger 24 operating the solenoid valve 42. It is appreciated that the trigger can operate the solenoid valve either mechanically, such as with a mechanical switch, or electronically. In one embodiment of the present invention, an electronic control circuit 96 may be utilized for initiating the firing operation of a compressed gas gun of the present invention. The electronic control circuit 96 may be in electronic communication with the trigger, so that pulling the trigger will activate the electronic control circuit. When the trigger is actuated by a user, an electronic signal is sent to the control circuit. The control circuit opens the solenoid valve, allowing compressed gas to flow through the hammer conduit, firing the compressed gas gun. A microprocessor may be used as part of the control circuit to control gun operation, as well as to track variables of gun operation, including tracking data such as shots fired, power supply, game time, firing parameters, firing mode, etc. As shown in FIG. 4, a power source such as a battery 88 may be housed in the grip portion 94 of the trigger frame 92.

The pneumatic assembly of the present invention may also be used to convert an existing "autococking" compressed gas gun to include the pneumatic assembly disclosed herein. In that case, the original cocking rod, hammer and three-way valve may be replaced by one or more solenoid valves, hammer conduit and hammer of the present invention.

Figure 7:
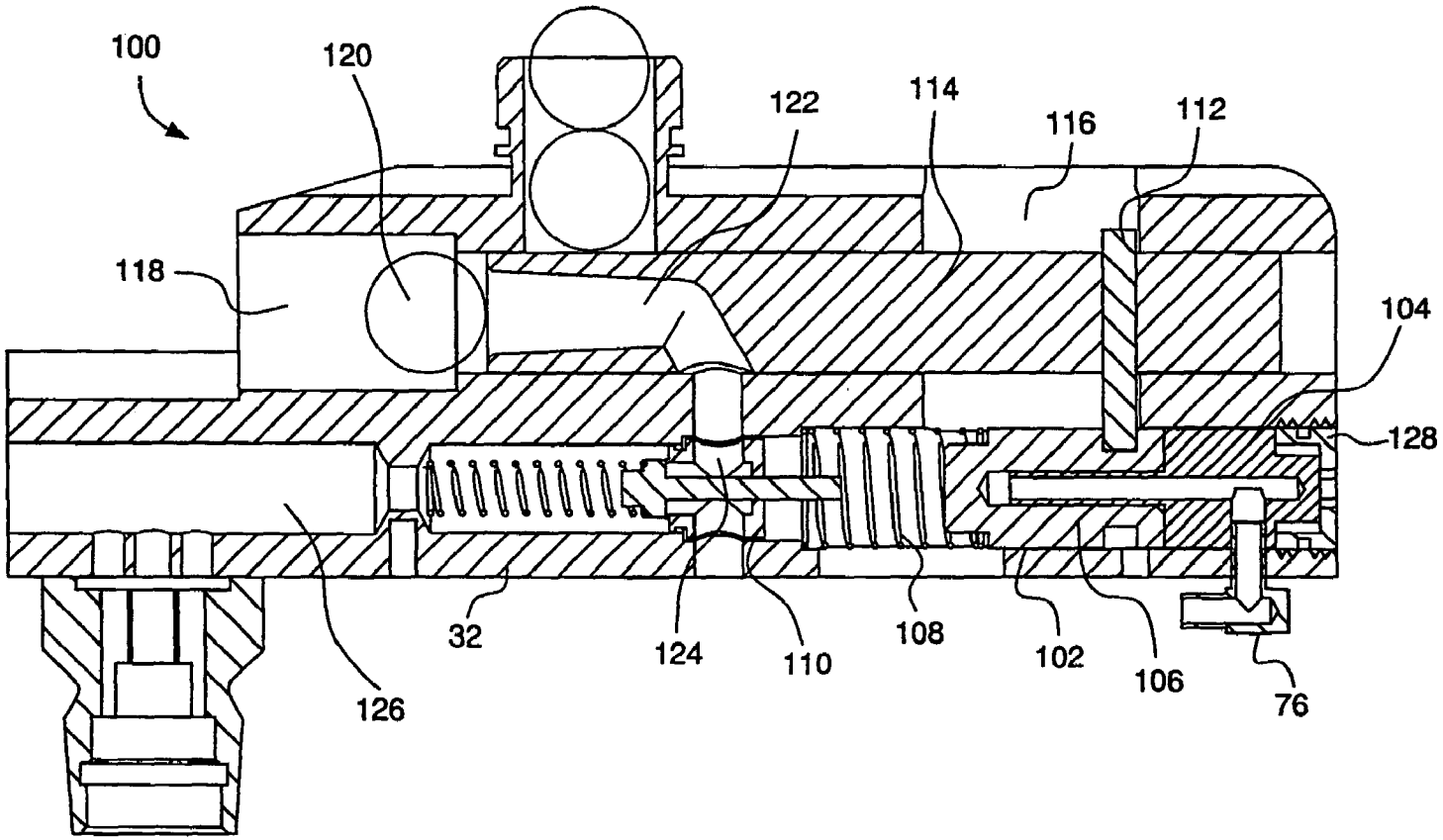
FIG. 7 is a cross-sectional side view of the body of an alternate embodiment of a compressed gas gun having a pneumatic assembly according to the present invention.
Figure 8:
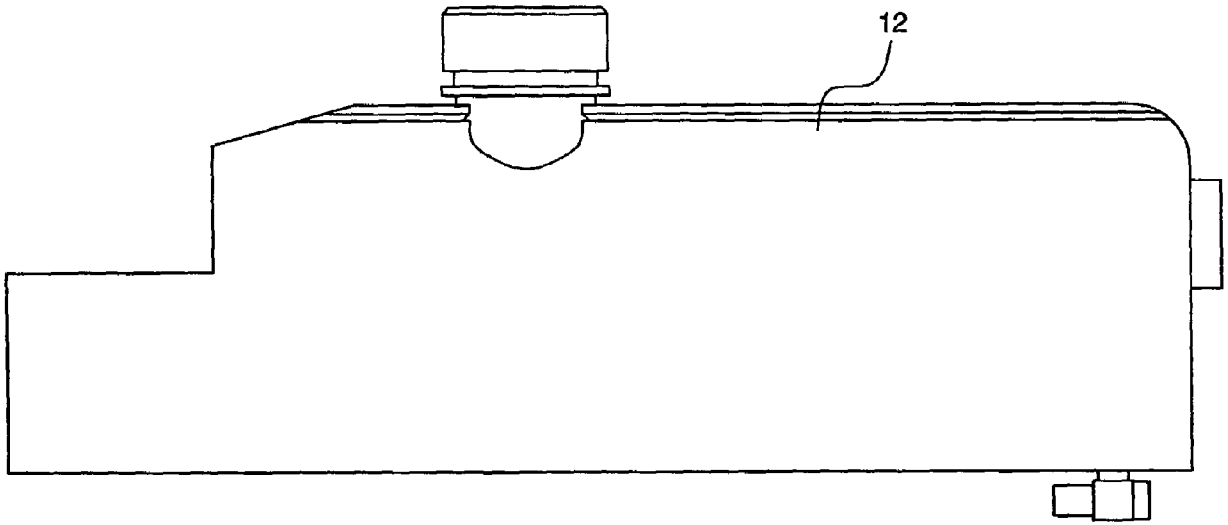
FIG. 8 is a side elevation view of an alternate embodiment of the body of a compressed gas gun according to the present invention.
Figure 9:
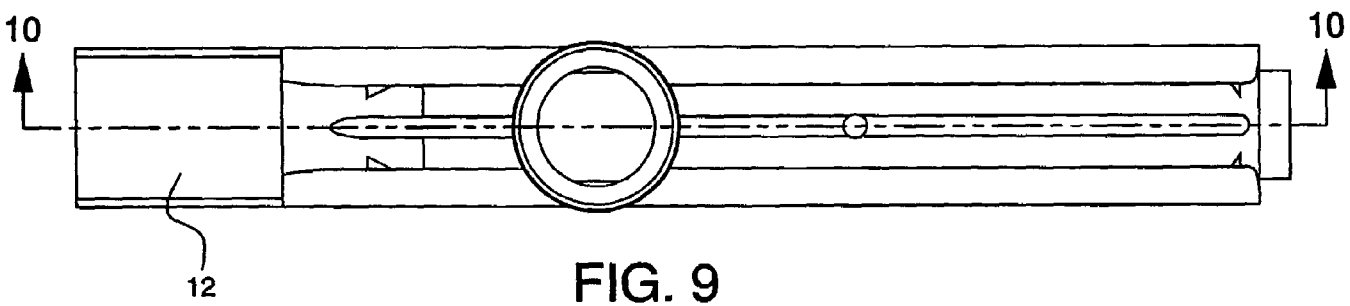
FIG. 9 is a top plan view of the compressed gas gun of FIG. 8.
Figure 10:
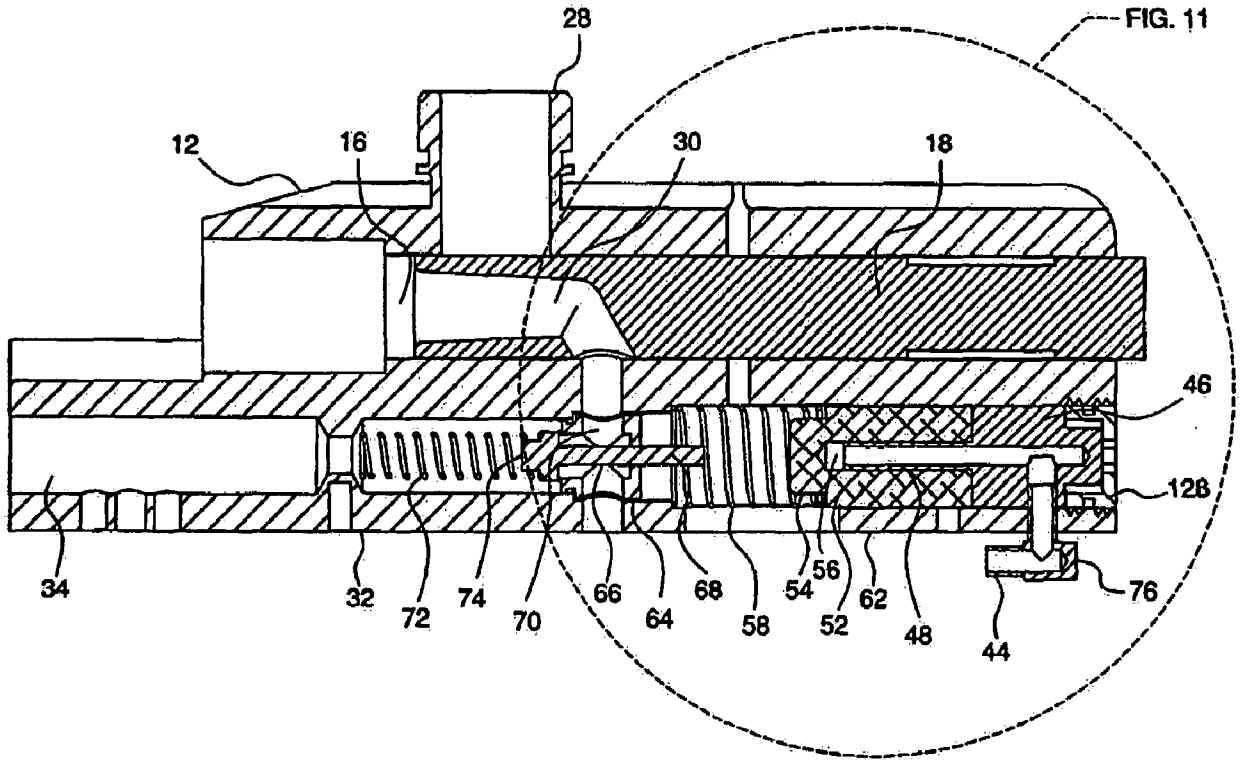
FIG. 10 is a cross-sectional side view of the compressed gas gun of FIG. 8.
Figure 11:
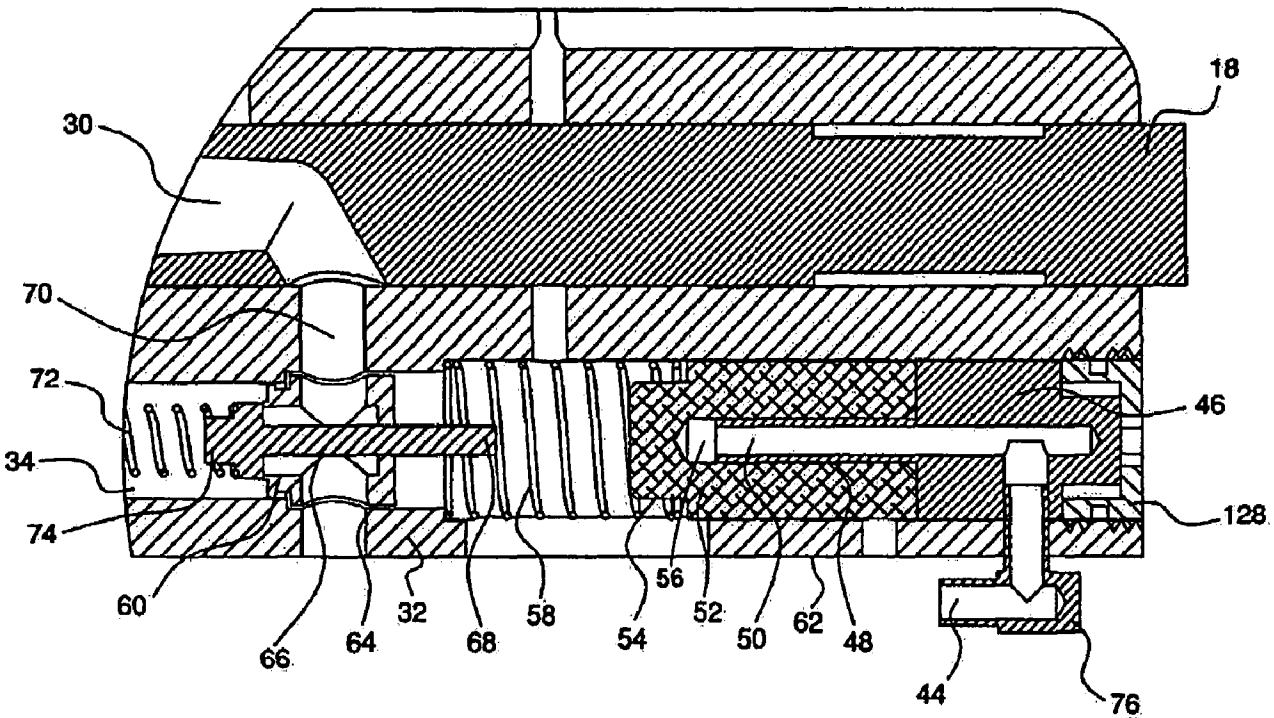
FIG. 11 is an enlarged cross-sectional side view of a portion of the compressed gas gun shown in FIG. 10.

Although illustrated as a closed bolt arrangement above, it is appreciated that the pneumatic assembly of the present invention may be employed in an open bolt compressed gas gun, as shown in FIG. 7. In the open bolt arrangement, a compressed gas gun body 100 has a hammer chamber 102 including a hammer conduit 104, and a hammer 106. A hammer return spring 108 is positioned between the hammer 106 and the discharge valve 110. A mechanical linkage 112 is provided, connected the hammer 106 to the bolt 114 of the gun. The mechanical linkage extends through a passage 116 between the breech 118 and the hammer chamber 102. Thus, when the hammer 106 reciprocates, the bolt 114 will be moved as well. When compressed gas is supplied through the hammer conduit 104, both the hammer 106 and the bolt 114 are moved to a forward or firing position. A paintball 120 is chambered in the breech. In a forward position, the bolt aperture 122 aligns with the flow passage 124 of the discharge valve 110. The hammer 106 strikes the discharge valve 110, opening the flow passage 124, and allowing compressed gas to be released from the high pressure chamber 126, to fire the paintball 120 from the gun.

The present invention is also directed to a compressed gun body, as shown in FIGS. 8-11, which may be offered as a replacement or "upgrade" or customizable body. The gun body 12 comprises a breech 16 which may include a bolt 18, or alternately, a bolt 18 can be offered separately from the body 12. A pneumatic assembly 32 comprises a high pressure chamber 34, a hammer chamber 62, and a discharge valve between the high pressure chamber 34 and hammer chamber 62. A conduit 44, with or without an exhaust valve 76 may be provided extending from the body 12, and capable of being attached to a separately offered trigger frame and solenoid valve. The hammer conduit 46 and hammer 52 are provided within the hammer chamber 62.

The components of the gun body, or discrete components of the pneumatic assembly, may be offered as parts of a "kit," with selective parts of the gun body or pneumatic assembly described herein included in the kit, so that a user may convert a compressed gas gun to operate according to the present invention.

Having thus described in detail several embodiments of the attachment system of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A pneumatic assembly for a compressed gas gun, comprising:

a high pressure chamber for receiving compressed gas from a compressed gas source, a hammer chamber, and a discharge valve between the hammer chamber and the high pressure chamber, wherein the hammer chamber comprises:

a hammer conduit disposed within the hammer chamber, at least a portion of the hammer conduit having a first diameter; and, a hammer moveable within the hammer chamber from a ready-to-fire position to a firing position adjacent the discharge valve, the hammer including an aperture having a diameter greater than the first diameter of the hammer conduit for receiving at least a portion of the hammer conduit within the aperture in at least the ready-to-fire position, wherein the hammer is biased to a ready-to-fire position by a hammer return spring.

2. The pneumatic assembly of claim 1, wherein the hammer return spring is positioned in the hammer chamber forward of the hammer.

3. The pneumatic assembly of claim 1, further comprising an exhaust valve in communication with the hammer conduit for venting compressed gas.

4. The pneumatic assembly of claim 1, further comprising a solenoid valve adapted to selectively control a supply of the compressed gas to the hammer conduit.

5. The pneumatic assembly of claim 4, wherein the solenoid valve is operated by a trigger.

6. The pneumatic assembly of claim 1, further comprising an electronic control circuit for controlling a firing operation of the compressed gas gun.

7. A compressed gas gun, comprising:

a gun body;

a pneumatic assembly disposed in the gun body, the pneumatic assembly including a high pressure chamber for receiving compressed gas from a compressed gas source, a hammer chamber, and a discharge valve between the hammer chamber and the high pressure chamber, wherein the hammer chamber comprises:

a hammer conduit disposed within the hammer chamber, at least a portion of the hammer conduit having a first diameter; and, a hammer moveable within the hammer chamber from a ready-to-fire position to a firing position adjacent the discharge valve, the hammer including an aperture having a diameter greater than the first diameter of the hammer conduit for receiving at least a portion of the hammer conduit within the aperture in at least the ready-to-fire position, wherein the hammer is biased to a ready-to-fire position by a hammer return spring.

8. The compressed gas gun of claim 7, wherein the hammer return spring is positioned in the hammer chamber forward of the hammer.

9. The compressed gas gun of claim 7, further comprising an exhaust valve in communication with the hammer conduit for venting compressed gas.

10. The compressed gas gun of claim 7, further comprising a solenoid valve adapted to selectively control a supply of the compressed gas to the hammer conduit.

11. The compressed gas gun of claim 10, wherein the solenoid valve is operated by a trigger.

12. The compressed gas gun of claim 7, further comprising an electronic control circuit for controlling a firing operation of the compressed gas gun.

13. A compressed gas gun, comprising:

a gun body;

a breech in an upper portion of the gun body;

a bolt moveable within the breech from a loading position to a firing position, the bolt having a bolt aperture therethrough;

a pneumatic assembly in a lower portion of the gun body, the pneumatic assembly including a high pressure chamber for receiving compressed gas from a compressed gas source, a hammer chamber, and a discharge valve between the high pressure chamber and the hammer chamber, wherein the hammer chamber comprises:

a hammer conduit disposed within the hammer chamber, at least a portion of the hammer conduit having a first diameter; and, a hammer moveable within the hammer chamber from a ready-to-fire position to a firing position adjacent the discharge valve, the hammer including an aperture having a diameter greater than the first diameter of the hammer conduit for receiving at least a portion of the hammer conduit within the aperture in at least the ready-to-fire position, wherein the hammer is biased to a ready-to-fire position by a hammer return spring;

a solenoid valve in communication with the compressed gas source and adapted to selectively direct compressed gas to the hammer conduit;

a trigger frame connected to the gun body including a trigger in communication with the solenoid valve for initiating a firing operation of the compressed gas gun.

14. The compressed gas gun of claim 13, further comprising an electronic control circuit for controlling a firing operation of the compressed gas gun.

15. A compressed gas gun body, comprising:

a breech in an upper portion of the gun body;

a pneumatic assembly in a lower portion of the gun body, the pneumatic assembly including a high pressure chamber for receiving compressed gas from a compressed gas source, a hammer chamber, and a discharge valve between the hammer chamber, wherein the hammer chamber comprises:

a hammer conduit disposed within the hammer chamber, at least a portion of the hammer conduit having a first diameter; and, a hammer moveable within the hammer chamber from a ready-to-fire position adjacent the hammer conduit to a firing position adjacent the discharge valve, the hammer including an aperture having a diameter greater than the first diameter of the hammer conduit for receiving at least a portion of the hammer conduit within the aperture, wherein the hammer is biased to a ready-to-fire position by a hammer return spring.

16. The gun body of claim 15, wherein the hammer return spring is positioned in the hammer chamber forward of the hammer.

17. The gun body of claim 15, further comprising a bolt moveable within the breech from a loading to a firing position, the bolt having a bolt aperture therethrough.

18. The gun body of claim 15, further comprising a conduit in communication with the hammer conduit extending from a lower portion of the gun body.

19. A method of firing a compressed gas gun, comprising:

providing a pneumatic assembly disposed in a gun body, the pneumatic assembly including a high pressure chamber for receiving compressed gas from a compressed gas source, a hammer chamber, and a discharge valve between the hammer chamber and the high pressure chamber;

providing a hammer conduit disposed within the hammer chamber, at least a portion of the hammer conduit having a first diameter;

providing a hammer moveable within the hammer chamber from a ready-to-fire position to a firing position adjacent the discharge valve, the hammer including an aperture having a diameter greater than the first diameter of the hammer conduit for receiving at least a portion of the hammer conduit within the aperture in at least the ready-to-fire position, wherein the hammer is biased to a ready-to-fire position by a hammer return spring;

providing a solenoid valve for selectively supplying compressed gas to the hammer conduit; and, providing a trigger adapted to operate the solenoid valve, whereby actuating the trigger initiates a firing operation.

* * * * *